United States Patent [19]

Ikushima et al.

[11] 3,959,749

[45] May 25, 1976

[54] FILTER OF THE DISTRIBUTED CONSTANTS TYPE

[75] Inventors: Horishi Ikushima, Katano; Hideo Yamaoki, Osaka, both of Japan

[73] Assignee: Matsushita Electric Industrial Co., Ltd., Osaka, Japan

[22] Filed: Oct. 29, 1974

[21] Appl. No.: 518,936

[30] Foreign Application Priority Data

| | | |
|---|---|---|
| Oct. 29, 1973 | Japan | 48-121924 |
| Oct. 30, 1973 | Japan | 48-122337 |
| Oct. 31, 1973 | Japan | 48-123162 |

[52] U.S. Cl. ..... 333/73 R; 333/33; 333/73 S; 333/84 R; 333/97 R

[51] Int. Cl.[2] ..... H01P 1/20; H01P 3/08; H01P 5/08

[58] Field of Search ..... 333/73 R, 73 S, 84 R, 333/84 M, 33, 97 R

[56] References Cited

UNITED STATES PATENTS

| | | | |
|---|---|---|---|
| 2,819,452 | 1/1958 | Arditi et al. | 333/73 S |
| 2,915,716 | 12/1959 | Hattersley | 333/73 S |
| 3,345,589 | 10/1967 | Di Piazza | 333/73 R |
| 3,534,301 | 10/1970 | Golembeski | 333/84 M X |
| 3,678,433 | 7/1972 | Hallford | 333/73 S |
| 3,721,919 | 3/1973 | Grace | 333/73 S X |
| 3,737,815 | 6/1973 | Long et al. | 333/73 R |

OTHER PUBLICATIONS

"Microwave Journal–Microwave Engineers Technical and Buyers Guide Edition" Horizon House, Dedham, Mass. Feb. 1969; cover page and pp. 65–69.

*Primary Examiner*—Alfred E. Smith
*Assistant Examiner*—Marvin Nussbaum
*Attorney, Agent, or Firm*—Wenderoth, Lind & Ponack

[57] ABSTRACT

A filter of the distributed constants type which has a dielectric substrate, a transmission line electrode and at least one branch electrode on the dielectric substrate, the branch electrode being connected to the transmission line electrode. This filter is advantageous because it is capable of easily eliminating or passing various frequency bands by changing the structure of the electrodes on the dielectric substrate. Further, wide band elimination and/or large attenuation can be easily achieved by connecting in series the filters having various electrode structures.

8 Claims, 10 Drawing Figures

FILTER OF THE DISTRIBUTED CONSTANTS TYPE

BACKGROUND OF THE INVENTION

This invention relates to a filter, and more particularly to an improved ceramic filter of the distributed constants type having a substrate of a dielectric with a high dielectric constant. Such a filter is very effective as a band-rejection filter over a wide range from the UHF to the SHF frequency band, and also it can also be used effectively to remove the undesired high frequency signal for an electronic circuit operating in the VHF or microwave range or to protect electronic equipment against a high frequency from a high frequency power source circuit the electronic equipment uses.

Conventional filters of the lumped constants type, which are formed by conventional discrete components such as a capacitor and a coil, do not perform well as a high frequency band-stop filter for the VHF band or the microwave range, and so usually there are used various filters using components such as a pair of parallel-coupled lines, coaxial lines and a wave guide tube, as a distributed constants type high frequency filter rather than a lumped constants type filter.

However, these conventional high frequency filters of the distributed constants type have some defects. That is, because very hige precision is required for these lines or the waveguide, the filters cannot be designed and manufactured practically with ease. Furthermore, because expensive materials are used for these lines or the waveguide, they cause increased consts in the manufacturing process. In addition, for achieving filter characteristics of operation over a wide frequency band and high performance such as a high electrical quality factor Q, it is inevitable that the construction of the filter circuit is inevitably inclined to be large in size.

SUMMARY OF THE INVENTION

Therefore, an object of the present invention is to provide an improved high frequency filter of the distributed constants type, by which these defects of the conventional high frequency filters can be overcome.

Another object of the present invention is to provide a novel and improved distributed constants type high frequency filter emplying a dielectric substrate.

A further object of the present invention is to provide a novel high frequency filter which is capable of eliminating or passing various frequency bands by changing the structure of the electrodes formed on the dielectric substrate.

A still further object of the present invention is to provide a novel band-elimination filter for a wide band and/or a large attenuation factor by connecting the filters having various electrode structures in series with each other.

These objects are achieved by providing a filter of the distributed constants type comprising a dielectric substrate of relatively high dielectric constant, a transmission line electrode, at least one branch electrode of high conductivity being electrically connected at one end thereof to the transmission line electrode and being on one surface of the dielectric substrate, and a ground electrode on the opposite surface of the dielectric substrate, the transmission line electrode extending transversely to the at least one branch electrode.

BRIEF DESCRIPTION OF THE DRAWINGS

These and other objects and features and advantages of the present invention will become apparent from consideration of the following detailed description of the invention taken together with the accompanying drawings, wherein.

DETAILED DESCRIPTION OF THE PREFERRED EMBODIMENT

Before the description of the distributed constants type filter according to the present invention, the amnner in which the inventors arrived at the idea for the present invention will be described immediately below.

It is well known that a surface elastic wave device, such as an interdigital transducer (IDT) can be used as a band-pass filter having a center frequency which is according to the pitch of the IDT and the material constants such as Young's modulus, mass-density, etc. of the substrate on which the electrodes are formed. On studying such a surface wave device, the inventors have found that by removing the counter electrode of an IDT, formed on a ferroelectric piezoelectric ceramic substrate, for exciting and/or receiving the surface elastic wave and applying an a.c. electric signal between the remaining electrodes and a common ground electrode formed on the back side of the ceramic substrate, the device acts as a band-rejection filter. In this case, the ceramic substrate which was used was a ferroelectric piezoelectric ceramic containing lead oxide as a main component and was 0.2 to 0.3 mm thick. It has been also found that the center frequency of this filter is according to the length of the electrodes. The present invention *i'* based upon these findings.

Figure 1:
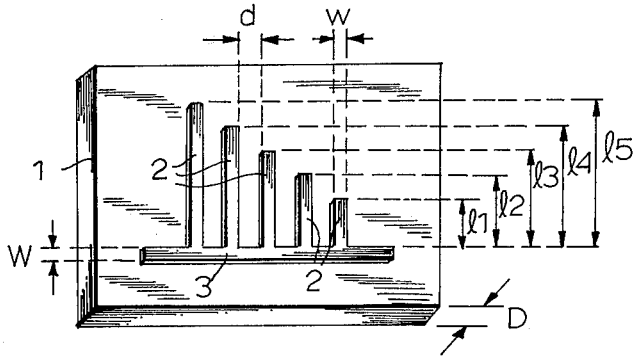
FIG. 1 is a perspective view of the basic structure of a filter according to the present invention.
Figure 2:
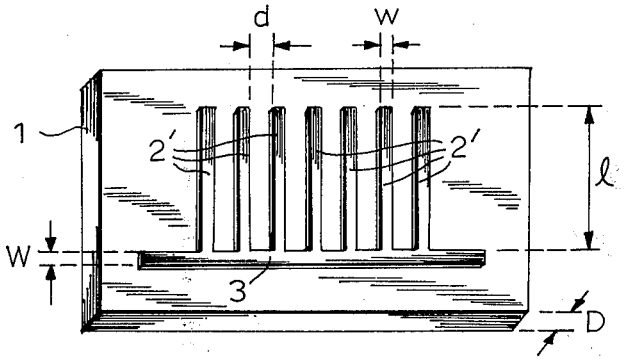
FIG. 2 is a perspective view of another basic structure of the filter of the invention.

The basic structure of the distributed constants type filter of the present invention is shown in FIGS. 1 and 2, in which the reference numeral 1 designates a substrate of dielectric or high resistance semiconductive material. It is not always required that the substrate 1 have ferroelectric or strong piezoelectric characteristics. Preferably, the substrate 1 is made of ceramic because of its high dielectric constant. A single phase electrode array 2 or 2' is formed on the substrate having parallel linear branch electrodes of different lengths $l_1, l_2, \ldots, l_5$ from each other or the same length $l$ as shown in FIGS. 1 or 2, respectively, and having a constant width $w$. The electrodes are of a material having a high conductivity and can be formed on the dielectric substrate by any conventional method such as electrolytic or electroless plating, sputtering, vacuum depositing, thermal depositing, coating, firing on, etc. The branch electrodes 2 or 2' are not required to be parallel and/or linear. The number of the branch electrodes 2 or 2' can be one at minimum. These electrodes 2 or 2' are commonly connected to a kind of transmission line electrode 3 of a highly conductive material and extending transversely of the branch electrodes 2 or 2'. The electrode 3 may also be formed on the substrate 1 by any conventional method. The thickness of the electrodes and the width $w$ are chosen according to the current value of the transmitted electric signal.

Although not visible in FIGS. 1 and 2, the back surface of the substrate 1 has thereon a ground electrode which has a uniform thickness and is large enough to cover the area opposite to the electrodes 2 and 3 (FIG. 1) or 2' and 3 (FIG. 2). Also, the ground electrode can be formed by any conventional method. The thickness D of the substrate 1 need only be sufficient to withstand well the input voltage applied between the electrode 3 and the ground electrode and such that the manufacturing of the substrate is not unduly troublesome. Although the number of branch electrodes is five (FIG. 1) or seven (FIG. 2), of course other numbers may be chosen accordint to the desired filter characteristics.

According to the experiments with the filters having the basic structure as described above, there have been obtained the following results:

1. The center frequency $f_i$ of the filter with respect to each branch electrode 2 is nearly proportional to each length $l_i$ ($i$=1, 2, 3, 4 and 5 in the case of FIG. 1) of the single-phase electrode array and the specific dielectric constant $\epsilon$ of the dielectric substrate, as expressed by the following equation (1):

$$l_i \alpha f_i^{-1} \cdot \epsilon^{-1/2} \qquad (1)$$

the equation(1) is equivalent to the equation for the wavelength compression ratio in microwave engineering. At the same time, it has also been found that the length $l_i$ is nearly a quarter of the wavelength.

2. The attenuation factor $\alpha$ of the frequency $f$ is nearly independent of the pitch $d$ of the branch electrodes in the electrode array. Although the attenuation factor $\alpha$ does not become large when the width $w$ of the branch electrodes is less than 0.1 mm, for a width larger than about 1 mm the attenuation factor $\alpha$ and the quality factor Q can be large enough to be practically used.

3. The Q-curve for the center frequency $f$, which is according to the equation (1), does not always coincide with the measured curve at a very low frequency such as a frequency lower than several mega Hertz. Therefore, even when the filter as described herein is made with a substrate material having a high Q-value at a low frequency range, it does not always have a high Q value. However, when the measured Q-value of the substrate material at a low frequency range lower than 1 MHz is higher than several dozens, there is hardly any difference of the characteristics due to the Q-value.

4. The Q-value changes according to the number of branch electrodes in FIG. 2, and the frequency F also changes slightly according to that number. For example, the Q-value increases greatly where there is a plurality of branch electrodes compared with the case of a single branch electrode. However, the frequency deviation from the center frequency $f$ differs somewhat according to the specific dielectric constant $\epsilon$ of the dielectric substrate and the other frequency deviates to a slightly higher value for a comparatively low $\epsilon$, i.e. lower than several dozen, and on the contrary to a slightly lower value for a comparatively high $\epsilon$ higher than several hundreds.

5. When a plurality of filters, each of which is as shown in FIG. 1 and in each of which the respective branch electrodes have the lengths $l_1, l_2, \ldots, l_5$, or each of which is as shown in FIG. 2 and the length $l$ for each filter is different from the length $l$ of the other filters, are connected by connecting the respective transmission line electrides in series as a common transmission line electrode, there is provided a synthesized band-rejection filter having a very wide band and a high Q or a high $\alpha$. Instead of directly connecting the transmission line electrodes in series, they can be connected in series via connecting means such as coaxial cable connectors. Further, these characteristics of the resultant filter are independent of the order and interval of the connection and become a maximum when the impedances of each lines are mutually matched.

Figure 3:
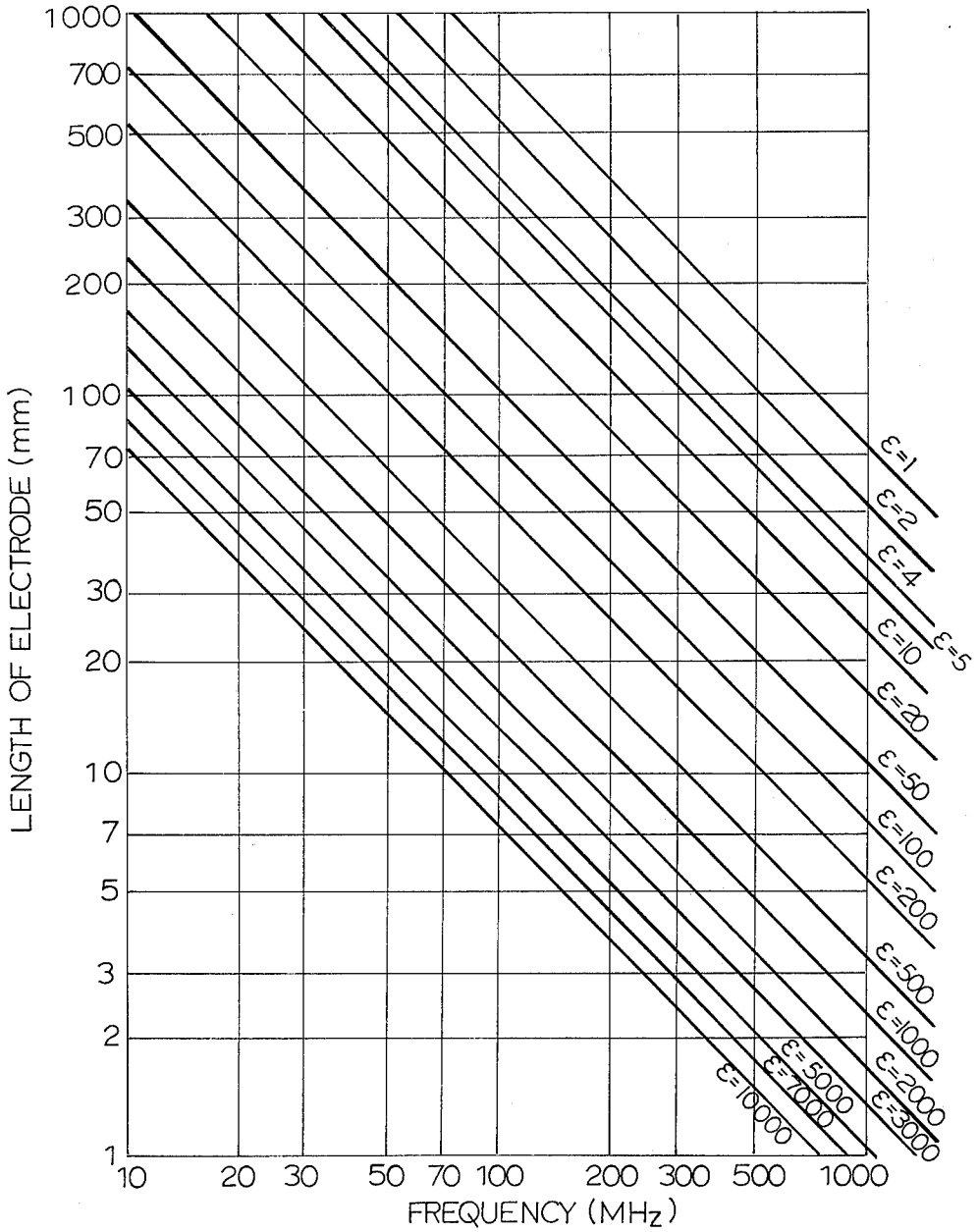
FIG. 3 is a graph showing the relation between the frequency and the length of the electrodes of the comb structure for designing the filter of the invention.

According to the results obtained as described above, the branch electrode length $l$ of the distributed constants type filter of the present invention can be accurately chosen according to the grape of FIG. 3. As can be understood from FIG. 3, for providing a filter for use in the microwave range of VHF and UHF bands, and further for use in the SHF band, it is desirable from a practical standpoint to use a substrate material having a specific dielectric constant of from several dozen to ten thousand.

Besides, the dielectric substrate 1 can be a single layer structre or a multi-layer structure because what is required according to the present invention is that there is a dielectric material between the electrode 3 and the ground electrode. The multi-layer structure can be used also for the sake of convenience of measurement. For example, if a ceramic substrate having electrodes 2 and 3 on one surface thereof and a ground electrode on the opposite surface thereof is stached on a polyester substrate, and the back surface of the polyester substrate has a further ground electrode thereon, and these two ground electrodes are electrically connected, then suce structure is also a filter within the present invention. When an input signal is applied to the electrode 3 and the ground electrode on the back surface of the polyester substrate, the filtering characteristics of such a filter are almost not different from those of a filter of a single layer of ceramic having electrodes 2 and 3 on one surface thereof and a ground electrode on the opposite surface thereof.

EXAMPLES

According to the graph of FIG. 3, and using the dielectric ceramics having a specific dielectric constant of the values as described directly as the substrate plate, practical distributed constants type ceramic filters were designed and made as described in the following.

For the substrate material, the following three kinds of ceramics were employed.

i. $CaTiO_3$ ceramic ii. $Pb(Mg_{1/3}Nb_{2/3})TiZrO_3$ ceramic iii. $BaTiO_3$ ceramic These ceramics (i), (ii), an (iii) were fired at 1240°C for 2 hrs, in air, at 1250°C for 45 min. in air, and at 1360°C for 2 hrs. in air, respectively, and had specific dielectric constants of $\epsilon$ of 80, 400 and 8,000, respectively.

Figure 4:
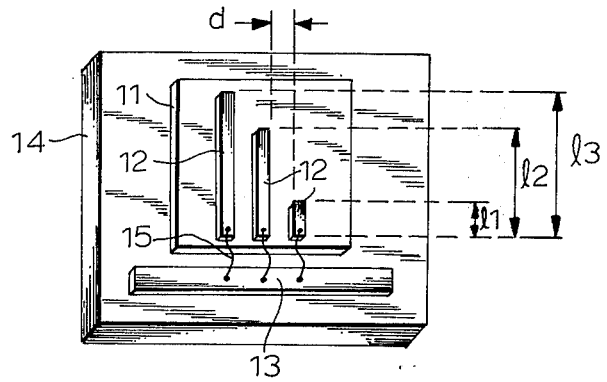
FIG. 4 is a perspective view of a practical design for a filter according to the basic structure of FIG. 1.
Figure 5:
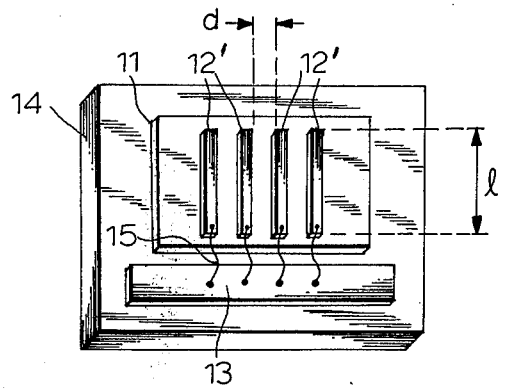
FIG. 5 is a perspective view of another practical design for a filter according to the basic structure of FIG. 2.

Employing the ceramic substrates as described above, one filter as shown in FIG. 4 and three filters as shown in FIG. 5 were made. The branch electrodes 12 or 12' were formed by firing teem onto the ceramic substrate 11 which was made of one of the above ceramics (i), (ii) or (iii). Substrate 11 was in turn mounted on polyester substrate 14. Each of the branch electrodes had a uniform width of 1 mm and was at a uniform spacing of 1 mm from the next adjacent branch electrode. The lengths $l_1$, $l_2$ and $l_3$ of the three branch electrodes 12 in FIG. 4 were 3 mm, 9mm and 12 mm, respectively, and the length $l$ of each of the four branch electrodes in the filters as shown in FIG. 5 was 9 mm. The transmission line electrode 13, which corresponds to the transmission line electrode 3 in FIGS. 1 and 2, was mounted directly on the substrate 14 made of polyester and it was connected electrically to the branch electrodes 12 or 12' with lead wires 15.

On the rear surface of the ceramic substrate 11 of each filter there was fired-on a silver electrode (ground electrode) with an area large enough to include the surface opposite to the three branch electrodes (FIG. 4) or the four branch electrodes (FIG. 5). Also, a further ground electrode formed on the back side of the polyester substrate 14 (not visible in FIGS. 4 and 5) was connected to the above silver electroded rear surface of the ceramic substrate 11. The transmission line electrode 13 and the ground electrode on the back side of the polyester substrate 14 were copper foil formed by plating. The reason why the transmission line electorde 13 was formed separately from the interdigital array of branch electrodes as shown in FIGS. 4 and 5, different from the arrangement of FIGS. 1 and 2, was just for convenience of measurement. For impedance matching between the output impedance of the test oscillator and the input impedance of the detector, the thickness of the substrates 14 and the width of the electrode 13 was made to about 2 mm and 3 mm, respectively, in all the filters.

The characteristics of the filters which were manufactured *a'* described above were then measured connecting the end of the transmission line electrode 13 and the ground electrode on the rear of the substrate 14 to a test oscillator via a coaxial cable of the BNC type, and supplying a signal from the oscillator to the electrode 13 and feeding tee output therefrom to a detector by connecting the other end of the electrode 13 and the ground electrode to the detector.

Figure 6:
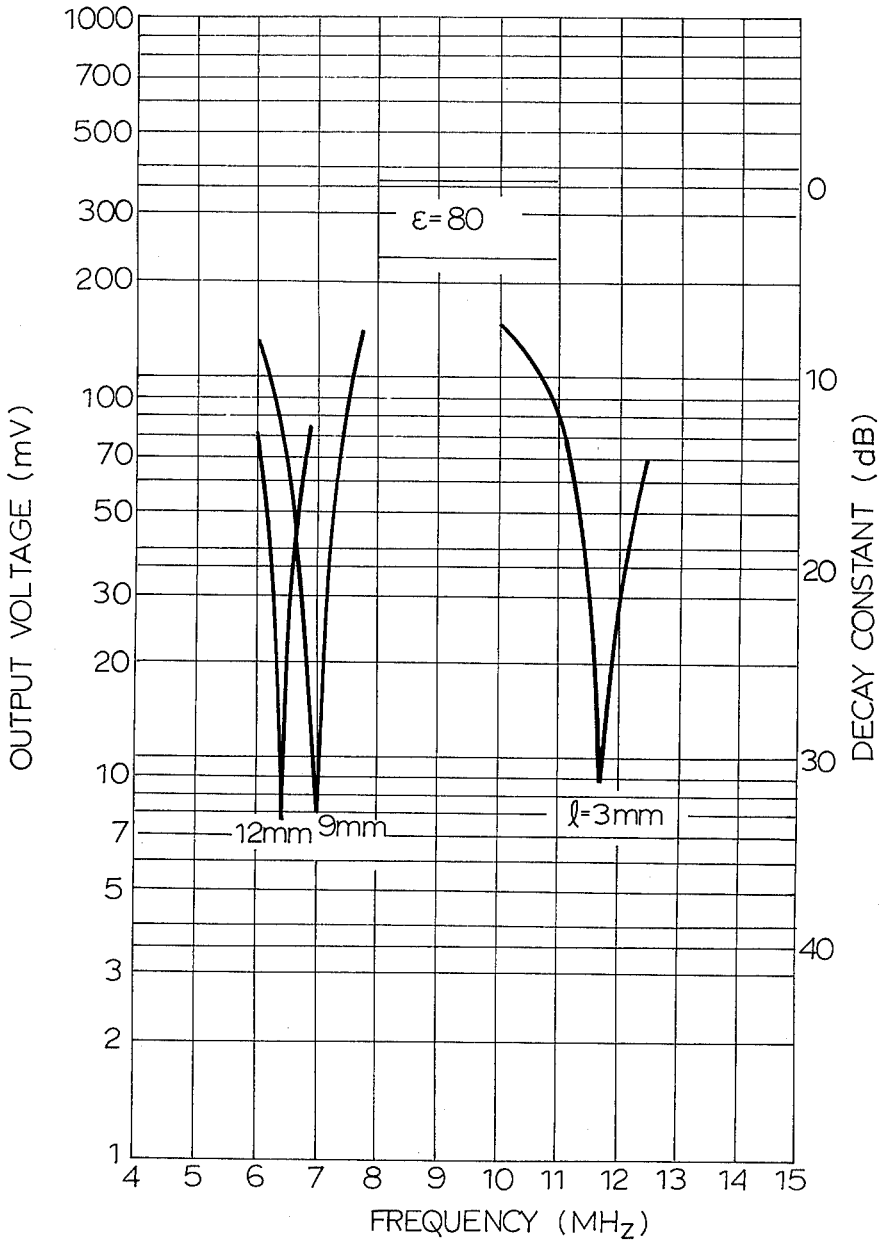
FIGS. 6 and 7 are graphs showing the passing characteristics of the filter of FIG. 4, respectively.
Figure 7:
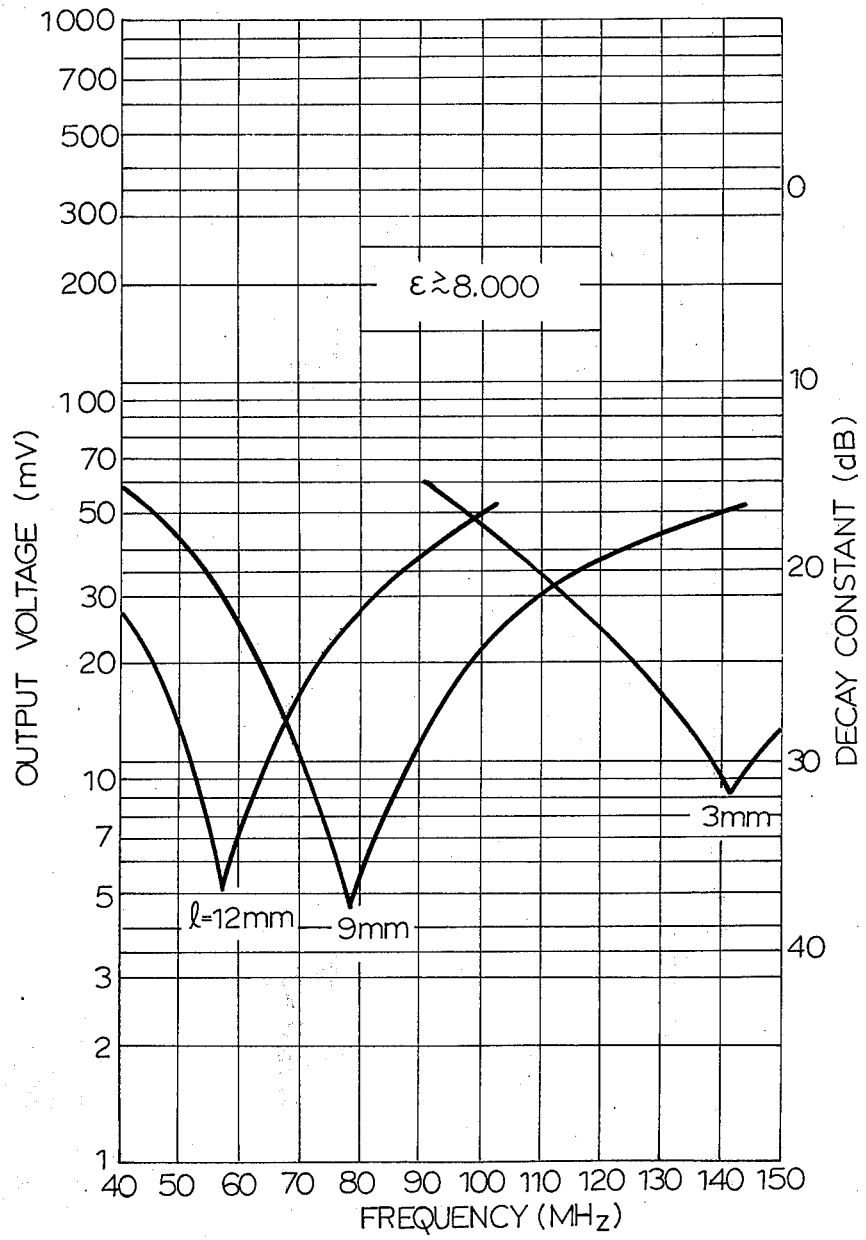

FIGS. 6 and 7 show the results of the measurements taken on a filter according to FIG. 4 utilizing as the substrate material the ceramics (i) and (ii), respectively. the center frequencies in FIGS. 6 and 7 nearly coincide with the estimated values from the equation (1) and the graph of FIG. 3. As for the substrate of the ceramic (iii), there were obtained results similar to those shown in FIGS. 6 and 7, and so the illustration of these results has been omitted.

The length of the lead wire corresponding to the wire 15 in FIGS. 4 and 5 was 3 to 4 mm in the above measurements. For a comparatively short length of the branch electrode, such as $l$=3 mm, in the above examples, the center frequency may deviate due to influence of the lead wire 15. However, if the length of the lead wire 15 is sufficiently short, the influence of the lead wire 15 is negligible. The above results were all based on measurements for individual branch electrodes in the electrode array obtained by connecting only one lead wire at a time and disconnecting the other lead wires corresponding to the wires 15 in FIG. 4. When the branch electrodes of different length from each other of FIG. 4 are all connected to the transmission line electrode 3 at once, various kinds of band filters can be provided by changing the length $l$ and/or the number of the branch electrodes depending on the desired characteristics. Namely, there can be provided a low pass filter, a high pass filter and a band-rejection filter, and further there can be provided a kind of band-pass filter by combining these filters with each other.

Figure 8:
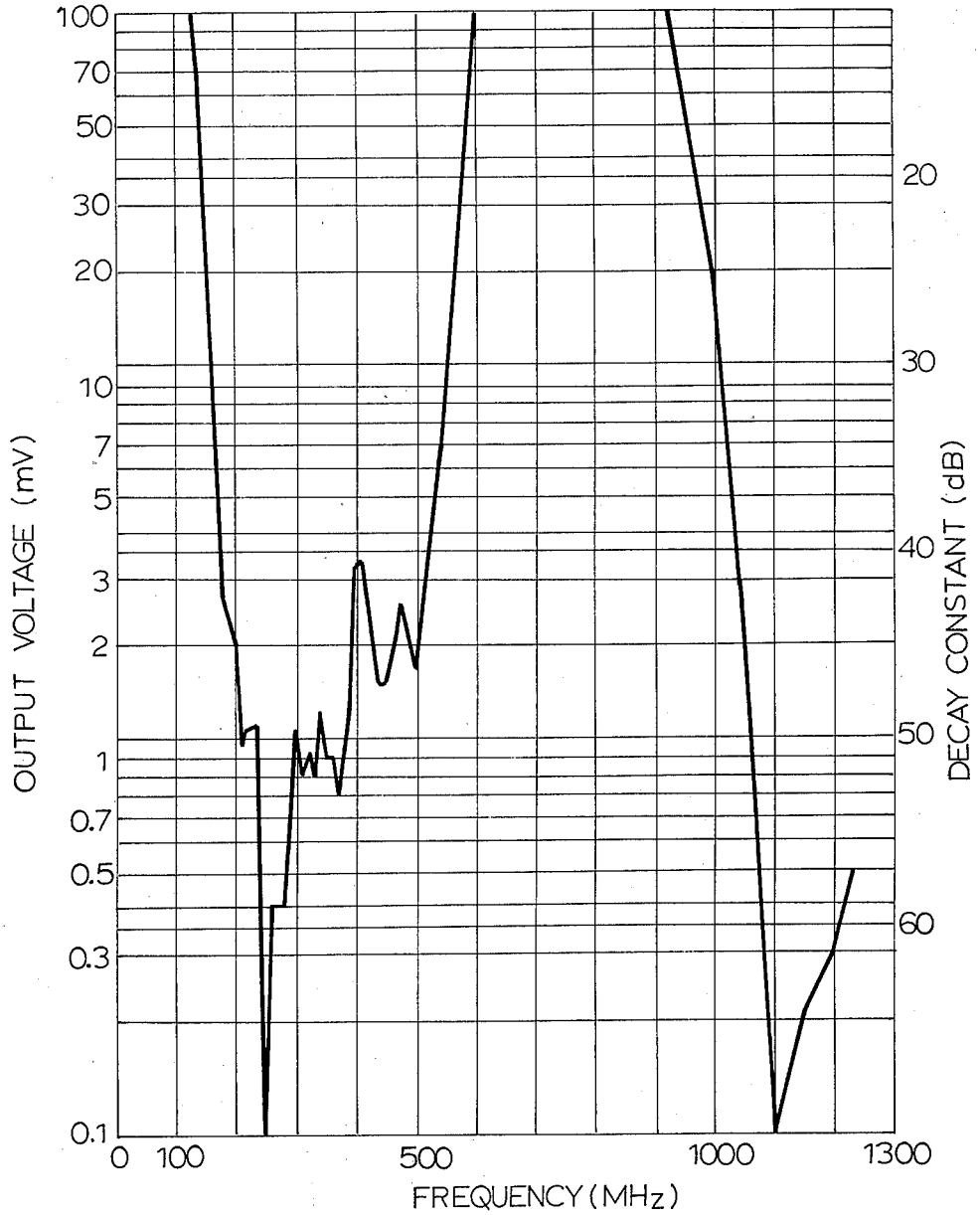
FIG. 8 is a graph showing the passing characteristic of a series connection of a plurality of filters of FIG. 4.

FIG. 8 shows the characteristics of the filter obtained when all the branch electrodes having lengths of $l_1$, $l_2$ and $l_3$ as shown in FIG. 4 and described above were used with the substrate of the ceramic (ii). As can be easily understood from FIG. 8, the filter possesses a kind of band-rejection filter characteristic in the frequency range from 200 to 500 MHz, and a kind of band-pass filter characteristic in the frequency range from about 600 to 900 MHz.

Figure 9:
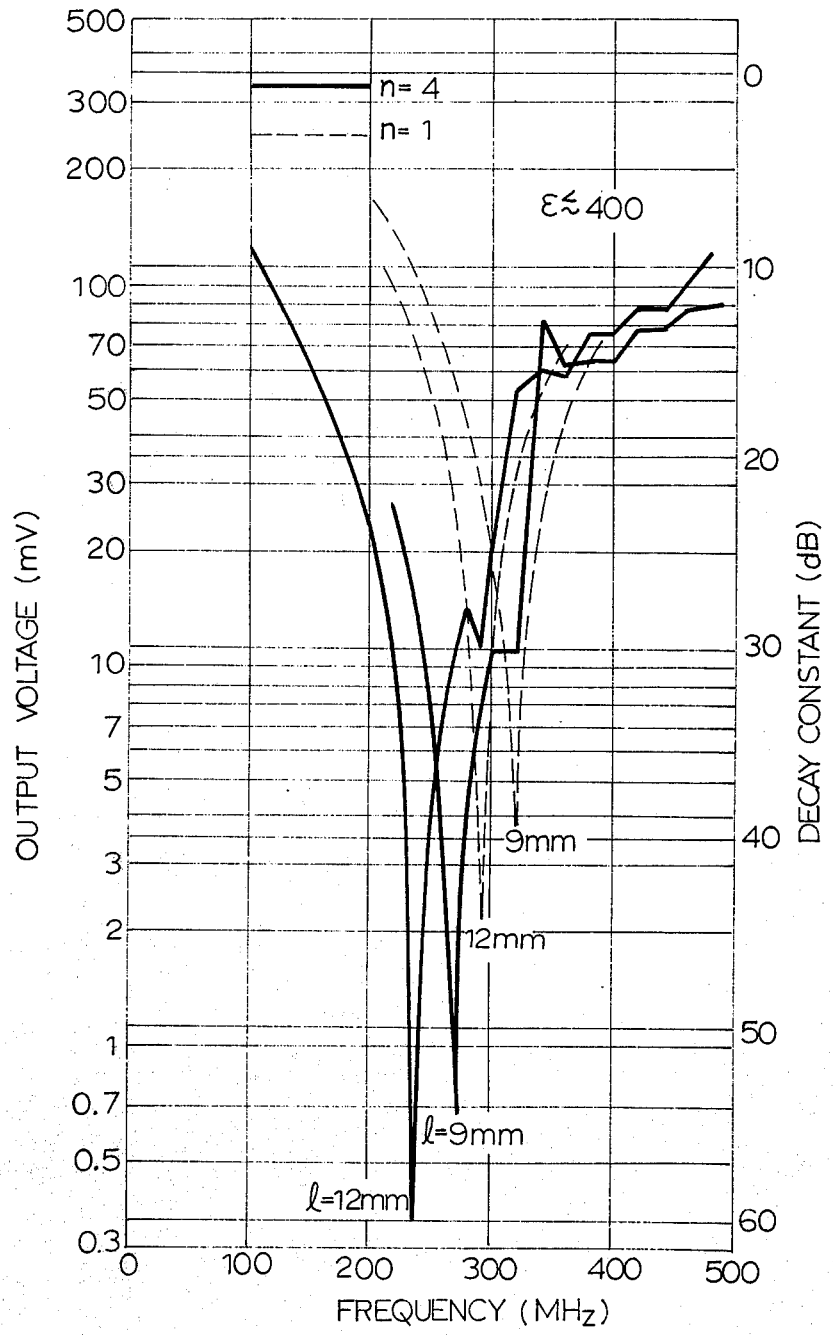
FIG. 9 is a graph showing the passing characteristics of the filter of FIG. 5.

FIG. 9 shows the characteristics of filters according to FIG. 5 with a substrate of the ceramic (ii) in which the number n of branch electrodes was one and four, respectively, and the length $l$ was 9 mm and 12 mm for both n=1 and 4. As described in paragraph (4) hereinbefore, the center frequency (f) deviates slightly to a lower value in the case of $n$=4. The value of $\alpha$ in the above cases also increases by more than about 10 dB for both electrode lengths of 9 mm and 12 mm where n is increased from 1 to 4.

Figure 10:
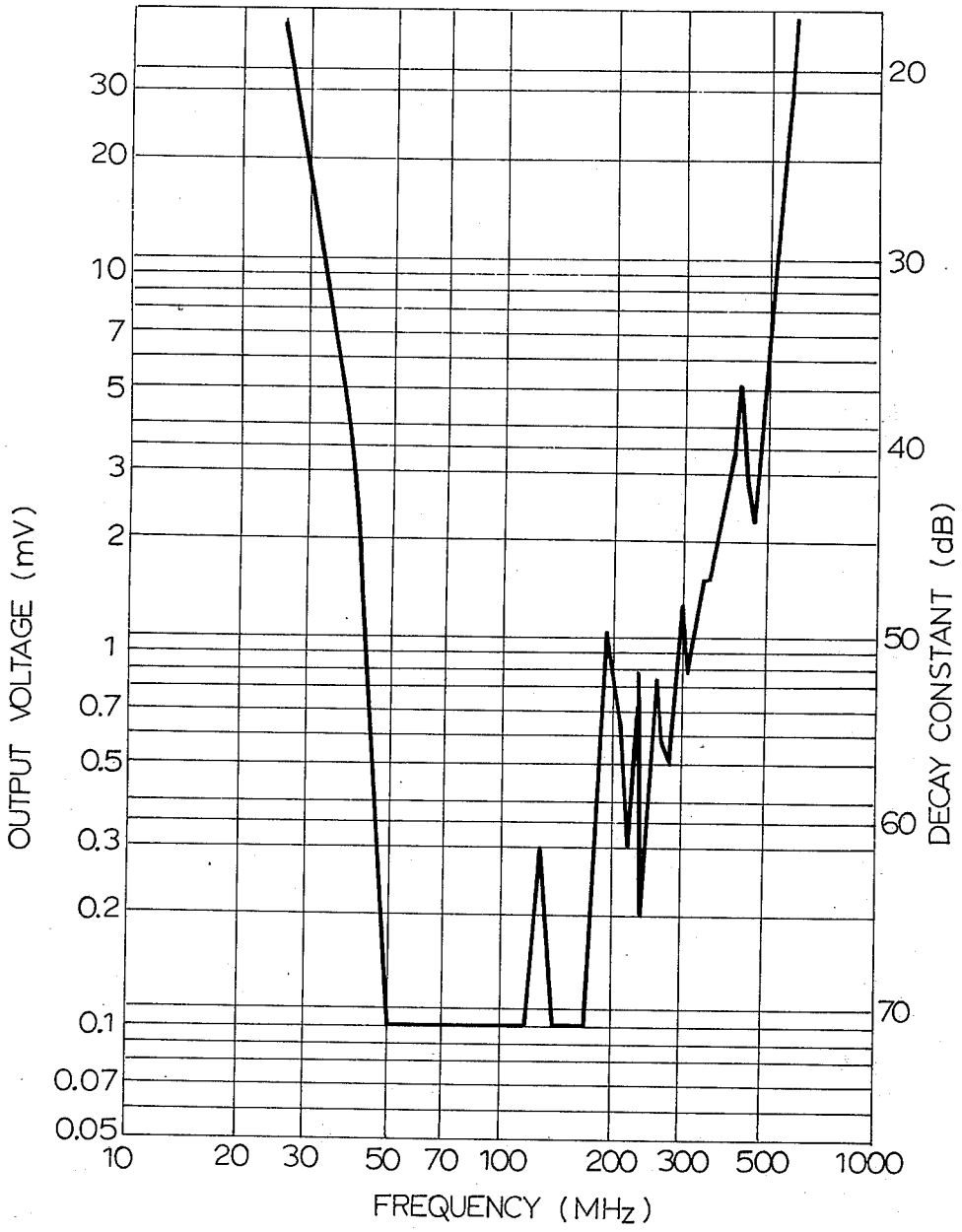
FIG. 10 is a graph showing the passing characteristic of a series connection of a plurality of filters of FIGS. 4 and 5.

FIG. 10 shows the characteristic of a filter constructed of three filter elements according to FIG. 5 having electrode lengths $l$ of 3 mm, 9 mm and 12 mm, respectively, the transmission lines of which were connected in series by a coaxial cable connectors, and having a substrate of the ceramic (iii). As is obvious from FIG. 10, there is provided a kind of band-rejection filter having a large attenuation factor in a very wide band. Even when there was no impedance matching at the connection of the transmission line electrodes, $\alpha$ did not decrease above several dB in value.

As will be understood from the examples set forth hereinbefore, for making a distributed constants type filter of the present invention mainly for use in the microwave range, it is desirable to choose a specific dielectric constant $\epsilon$ for the material of the substrate between several dozens and several thousands for widening the frequency range and for miniturization of the filter.

In the present invention, for the purpose of carrying out the invention easily and practically, dielectric materials which have been used conventionally and practically are selected as the material of the dielectric substrate. That is, the preferable lower limit of the specific dielectric constant $\epsilon$ is 30, which is that for titanium dioxide ($TiO_2$) ceramic, and the preferable upper limit is 8000, which is that for barium titanate ($BaTiO_3$) ceramic. Of course, it is also possible to use another material having a specific dielectric constant outside of the above range, whether it be a ceramic or not, for the dielectric substrate of the distributed constants type filter of the present invention according to the desired use, if such a material is newly developed.

Hence, it will be easily understood that the filter according to the present invention, the idea for which was derived from the experimental facts newly discovered by the present inventors, has the following merits.

First, the filter of the invention can be used in a wide range of microwaves, from VHF to UHF and further to the SHF band. Second, it is very cheap compared with a conventional filter, such as a waveguide or a coaxial cable. Third, the filter can be miniaturized so that it has a size which at the largest is several square centimeters. Further, when ceramic is used as the dielectric substrate forming the main part of the filter of the invention, the filter is nonflammable. Furthermore, as only the dielectric property among the electric properties of the dielectric substrate is used for filter action, a polarizing process for providing a piezoelectric property is not required, which is different from the case of a mechanical filter.

While certain specific embodiments have been shown and described, it will, of course, be understood that various other modifications may be devised by those skilled in the art which will embody the principles of the invention and be within the true spirit and scope thereof.

What is claimed is:

1. A filter of the distributed constants type comprising a first dielectric substrate of ceramic material having a specific dielectric constant in the range of 30 to 800, a transmission line electrode, at least one branch electrode being electrically connected to said transmission line electrode and being on one surface of said dielectric substrate, a ground electrode on the opposite surface of said dielectric substrate, and a second dielectric substrate having a specific dielectric constant less than 30, said tranmission line electrode being on said second substrate.

2. A filter as claimed in claim 1 wherein there is a plurality of branch electrodes, and each branch electrode has a different length from the others.

3. A filter as claimed in claim 1 wherein there is a plurality of branch electrodes, and all the branch electrodes have the same length.

4. A filter as claimed in claim 1 wherein said first substrate is on said second substrate.

5. A filter of the distributed constants type comprising a plurality of filter means, each of said filter means comprising first a dielectric substrate of ceramic material having a specific dielectric constant in the range of 30 to 800, a transmission line electrode, and at least one branch electrode being electrically connected to said transmission line electrode and being on one surface of said dielectric substrate, a ground electrode on the opposite surface of said dielectric substrate, and a second dielectric substrate having a specific dielectric constant less than 30, said transmission line electrode being on said second substrate, said transmission line electrodes being connected in series.

6. A filter as claimed in claim 5, wherein there is a plurality of branch electrodes in each filter means, and each of said branch electrodes of each filter means has a different length from the others, the corresponding branch electrodes in the respective filter means being the same length.

7. A filter as claimed in claim 5, wherein there is a plurality of branch electrodes in each filter means, and each of said branch electrodes in each filter means has the same length, and the branch electrodes in the respective filter means have different lengths from each other.

8. A filter as claimed in claim 5 wherein said first substrate is on said second substrate.

* * * * *

UNITED STATES PATENT AND TRADEMARK OFFICE

CERTIFICATE OF CORRECTION

PATENT NO. : 3,959,749

DATED : May 25, 1976

INVENTOR(S) : HIROSHI IKUSHIMA et al.

It is certified that error appears in the above-identified patent and that said Letters Patent are hereby corrected as shown below:

Claim 1, line 4, "800" should read --8000--;

Claim 5, line 5, "800" should read --8000--.

Signed and Sealed this

Eighteenth Day of January 1977

[SEAL]

*Attest:*

RUTH C. MASON
*Attesting Officer*

C. MARSHALL DANN
*Commissioner of Patents and Trademarks*